US007588458B2

(12) United States Patent
He et al.

(10) Patent No.: US 7,588,458 B2
(45) Date of Patent: Sep. 15, 2009

(54) ELECTRICAL CONNECTOR ASSEMBLY

(75) Inventors: Jia-Yong He, Kunshan (CN); Qi-Sheng Zheng, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/217,189

(22) Filed: Jul. 1, 2008

(65) Prior Publication Data

US 2009/0017695 A1 Jan. 15, 2009

(30) Foreign Application Priority Data

Jul. 10, 2007 (CN) ..... 2007 2 0040642

(51) Int. Cl.
*H01R 13/60* (2006.01)

(52) U.S. Cl. ..... 439/541.5; 439/607

(58) Field of Classification Search ..... 439/541.5, 439/607, 701

See application file for complete search history.

(56) References Cited

U.S. PATENT DOCUMENTS 5,755,595 A * 5/1998 Davis et al. ..... 439/607
6,120,321 A 9/2000 Wu
6,149,459 A * 11/2000 Yang ..... 439/541.5
6,162,089 A * 12/2000 Costello et al. ..... 439/541.5
6,238,241 B1 * 5/2001 Zhu et al. ..... 439/541.5
6,264,501 B1 * 7/2001 Hung et al. ..... 439/541.5
6,540,563 B1 4/2003 Hu et al.
7,488,207 B2 * 2/2009 Zheng et al. ..... 439/541.5
2007/0243757 A1 * 10/2007 Wan et al. ..... 439/541.5

* cited by examiner

*Primary Examiner*—Renee Luebke
*Assistant Examiner*—Larisa Tsukerman
(74) *Attorney, Agent, or Firm*—Wei Te Chung

(57) ABSTRACT

An electrical connector assembly (100) combining at least two different types of interfaces, includes a first housing (1) having a first mating portion (11) at a front surface and a protrusion (12) extending from a bottom surface thereof. The protrusion has an upper portion and a lower portion being wider than the upper portion. A set of first terminals (3) are mounted on the first housing and extend into the first mating portion thereof. A second housing (2) is assembled to the first housing. The second housing has a second mating portion (21) at a front surface and a recess (26) at a top surface thereof to retain the protrusion therein. The recess has an upper portion and a lower portion being wider than the upper portion. A plurality of second terminals (4) are mounted on the second housing and extend into the second mating portion thereof. A second inner shell (6) encloses the second mating portion of the second housing. The second inner shell has a top surface abutted against by the protrusion.

12 Claims, 7 Drawing Sheets

ELECTRICAL CONNECTOR ASSEMBLY

BACKGROUND OF THE INVENTION

1. Field of the Invention

The present invention generally relates to an electrical connector assembly and more particularly to an electrical connector assembly having different types of interfaces.

2. Description of Related Art

A conventional electrical connector assembly having different types of interfaces, comprises an insulative housing having a first mating portion for mating with a USB plug connector and a second housing having a second mating portion for mating with a SATA plug connector. A plurality of first terminals received in the first mating portion. A plurality of second terminals received in the second mating portion. The first mating portion and the second mating portion which have different types of interfaces integrally formed on the insulative housing will complicates the manufacturing process and increase the manufacturing costs. Furthermore, the insulative housing is a one-piece structure unitarily molded of dielectric material such as plastic or the like, the first mating portion and the second mating portion which look like the same color could not be identified easily, and it possible to mismate the plugs with the interfaces.

Hence, an improvement over the prior art is required to overcome the problems thereof.

SUMMARY OF THE INVENTION

According to one aspect of the present invention, an electrical connector assembly combining at least two different types of interfaces comprises a first housing having a first mating portion at a front surface and a protrusion extending from a bottom surface thereof. The protrusion has an upper portion and a lower portion wider than the upper portion. A plurality of first terminals are mounted on the first housing and extend into the first mating portion thereof. A second housing is assembled to the first housing. The second housing has a second mating portion at a front surface and a recess at a top surface thereof to retain the protrusion therein. The recess has an upper portion and a lower portion wider than the upper portion. A plurality of second terminals are mounted on the second housing and extend into the second mating portion thereof. A second inner shell encloses the second mating portion of the second housing. The second inner shell has a top surface abutted against by the protrusion.

According to another aspect of the present invention, an electrical connector assembly comprises a first housing having a pair of first mating portions for mating with USB plug connectors and a protrusion extending from a bottom surface thereof. The protrusion has an upper portion and a lower portion wider than the upper portion. A plurality of first terminals are mounted on said first housing and extend into the first mating portion thereof. A second housing assembled to the first housing. The second housing has a second mating portion for mating with a SATA plug connector and a pair of retaining posts extending from a top surface thereof. The retaining posts engage with opposite sides of the protrusion and have an upper portion and a lower portion narrower than the upper portion. A plurality of second terminals are mounted on the second housing and extend into the second mating portion thereof. A second inner shell encloses the second mating portion of the second housing. The second inner shell has a top surface abutted against by the protrusion.

These and additional objects, features, and advantages of the present invention will become apparent after reading the following detailed description of the preferred embodiment of the invention taken in conjunction with the appended drawings.

DETAILED DESCRIPTION OF THE INVENTION

Figure 1:
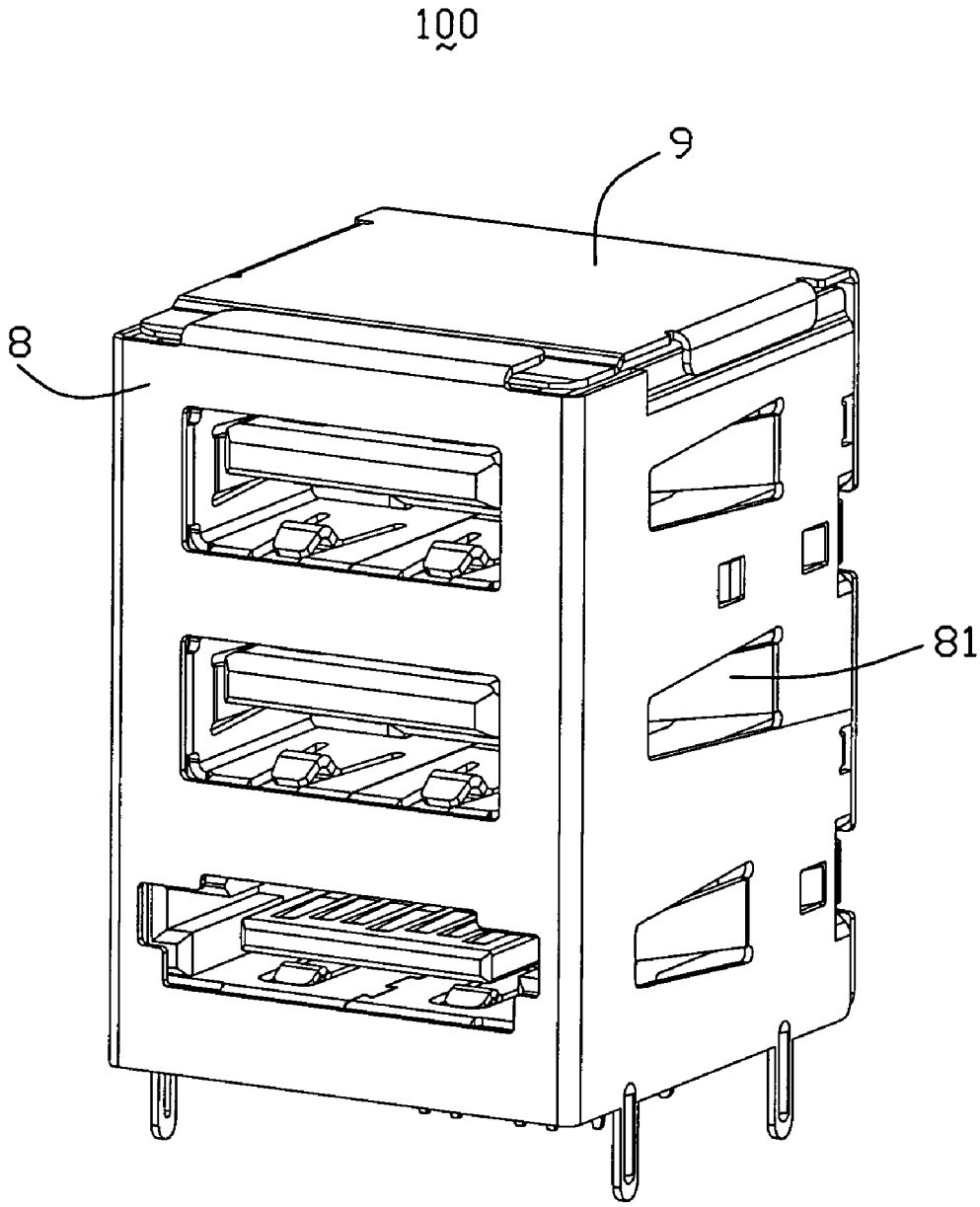
FIG. 1 is a front perspective view of an electrical connector assembly in accordance with the present invention.
Figure 2:
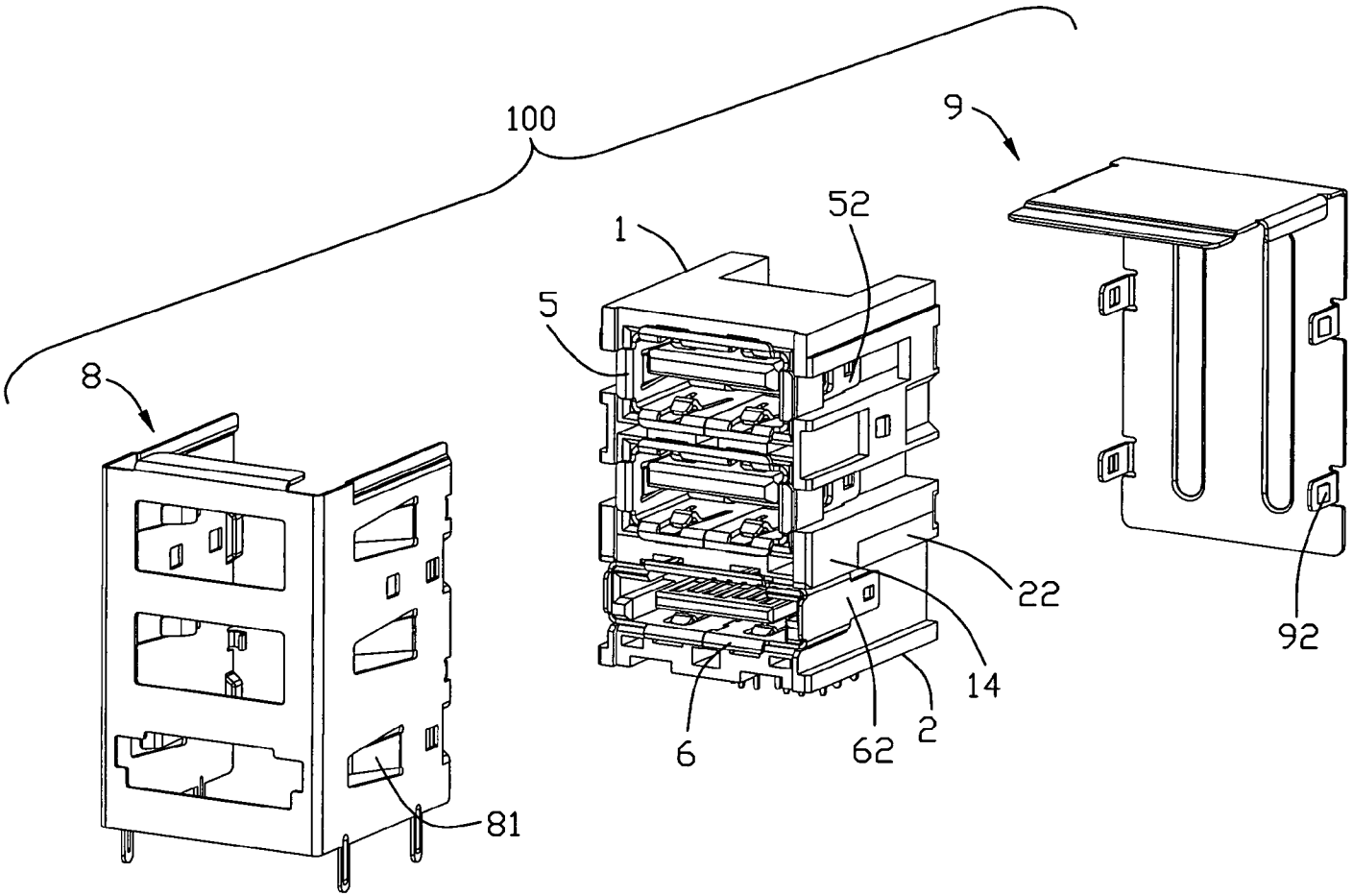
FIG. 2 is a front partially exploded view of the electrical connector assembly shown in FIG. 1.

Reference will now be made to the drawing figures to describe the preferred embodiment of the present invention in detail.

Figure 3:
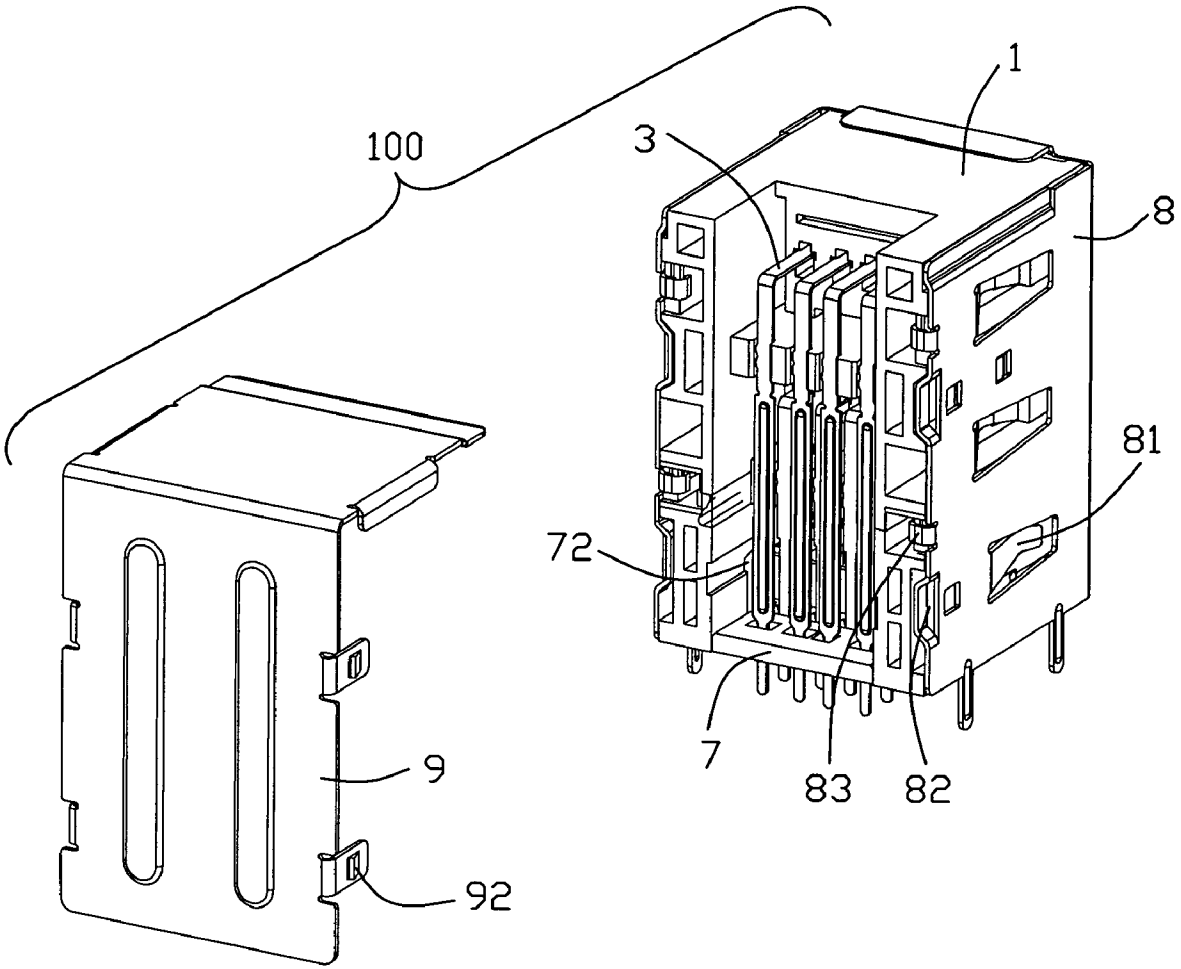
FIG. 3 is a rear perspective view of the electrical connector assembly with the rear shell removed shown in FIG. 1.
Figure 4:
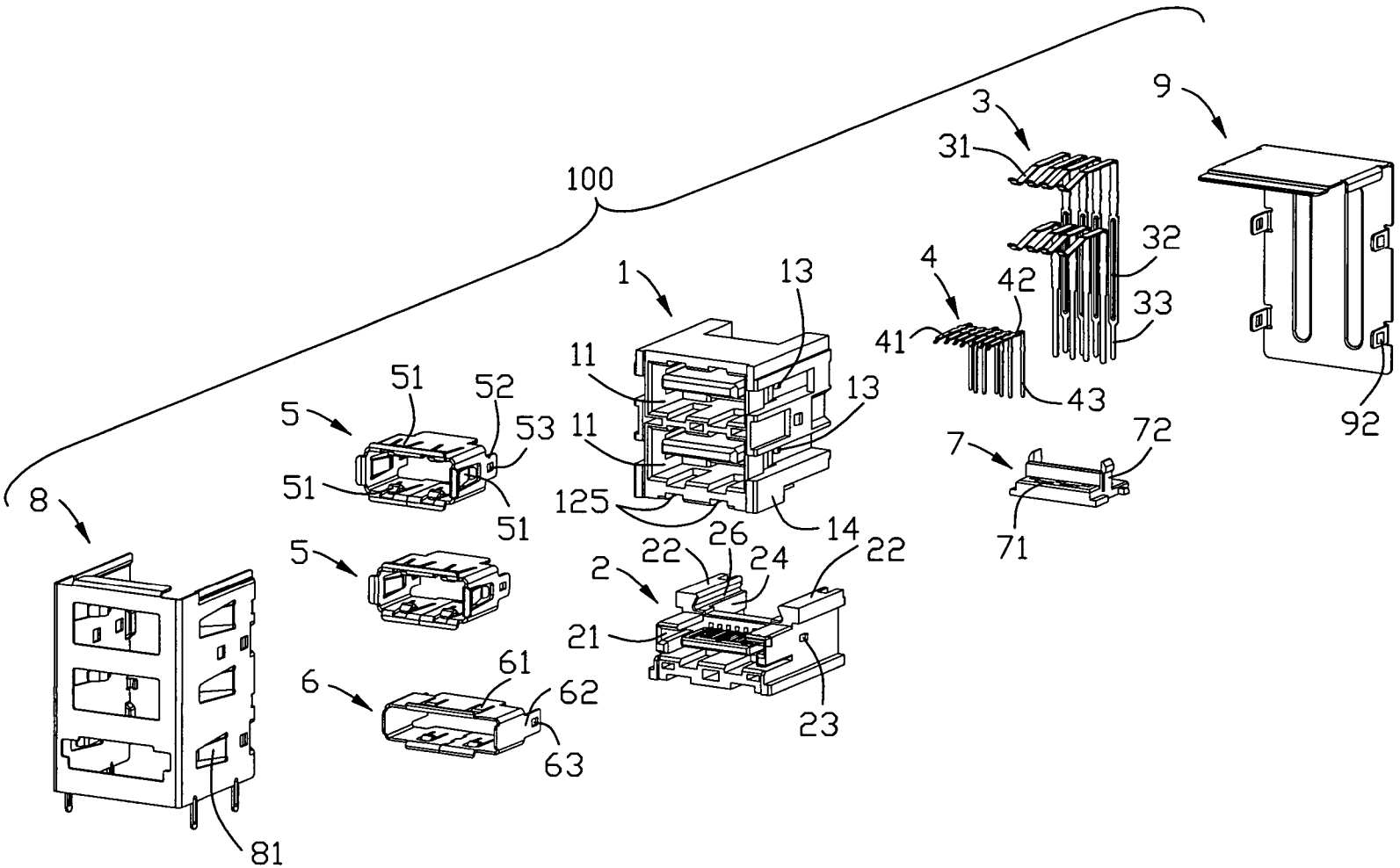
FIG. 4 is a front exploded view of the electrical connector assembly shown in FIG. 1.

Referring to FIGS. 3 and 4, the electrical connector assembly 100 according to the present invention, comprises a first housing 1, a plurality of first terminals 3 mounted on the first housing 1, a second housing 2 assembled to the first housing 1, a plurality of second terminals 4 mounted on the second housing 2, a pair of first inner shells 5 coupled to the first housing 1, a second inner shell 6 coupled to the second housing 2, a spacer 7 coupled to the second housing 2, an outer shell 8 enclosing the first housing 1 and the second housing 2, and a rear shell 9 coupled to the outer shell 8.

Figure 5:
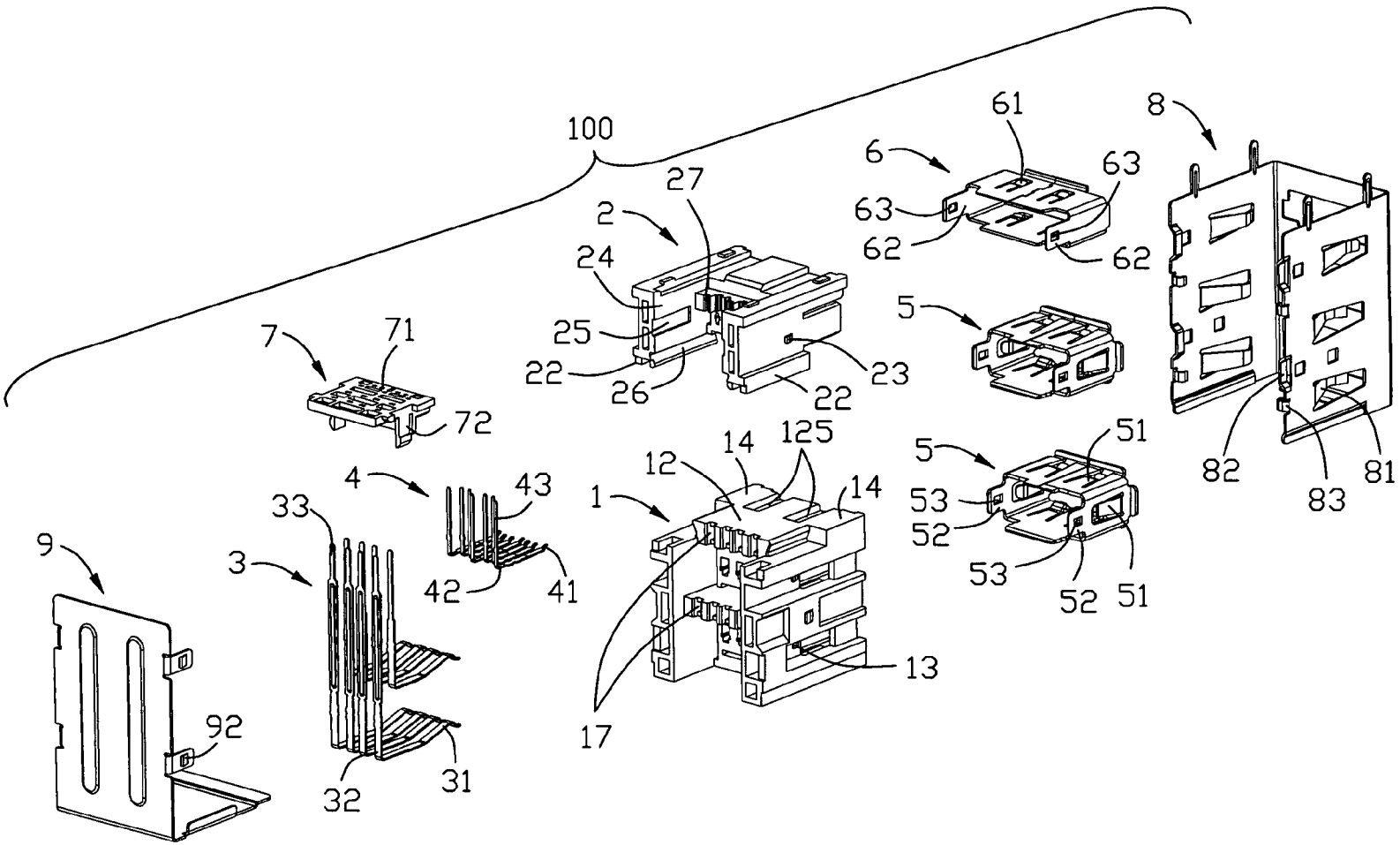
FIG. 5 is a rear exploded view of the electrical connector assembly shown in FIG. 1.
Figure 6:
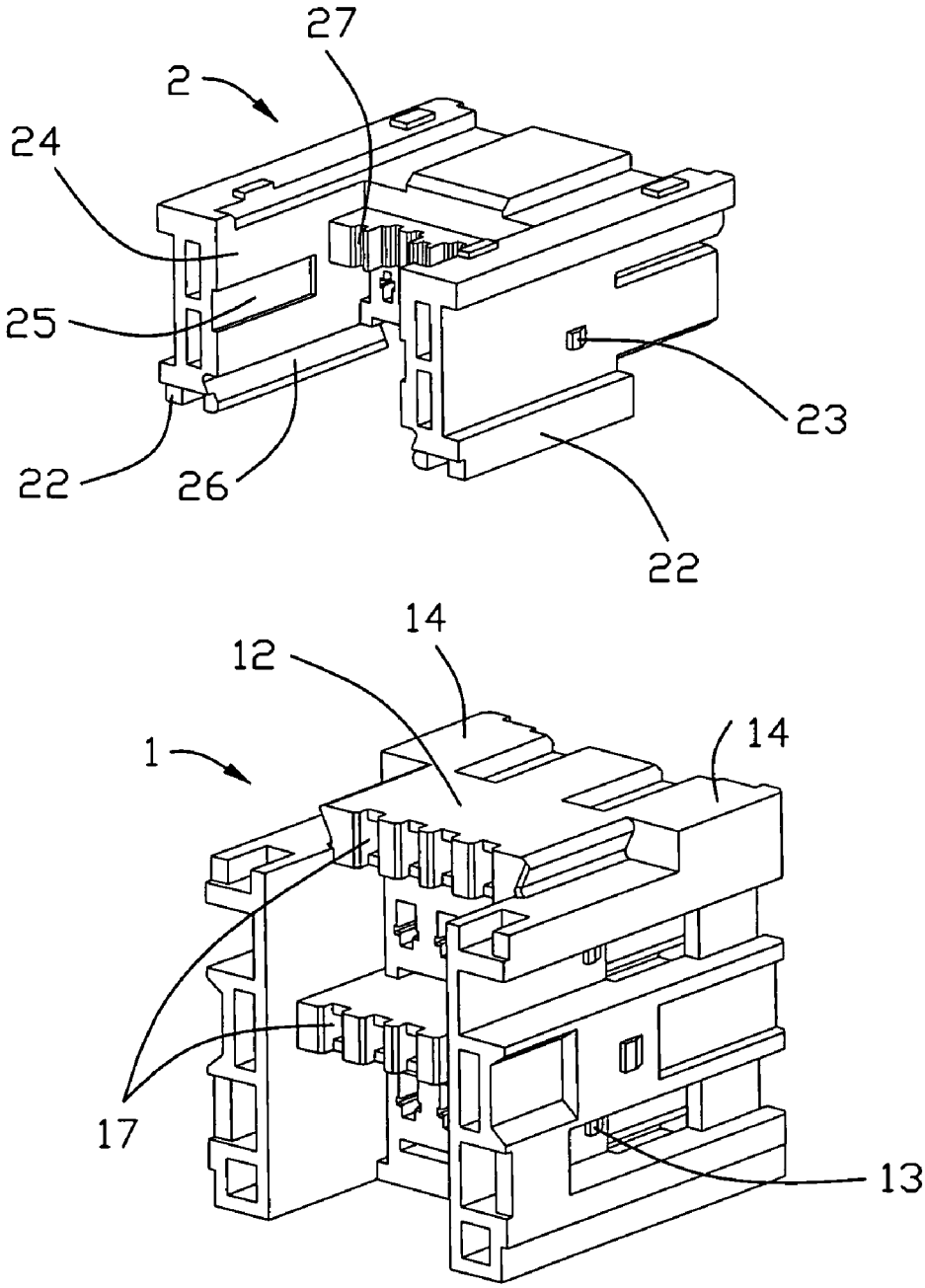
FIG. 6 is an enlarged view of the first and second housing shown in FIG. 1.
Figure 7:
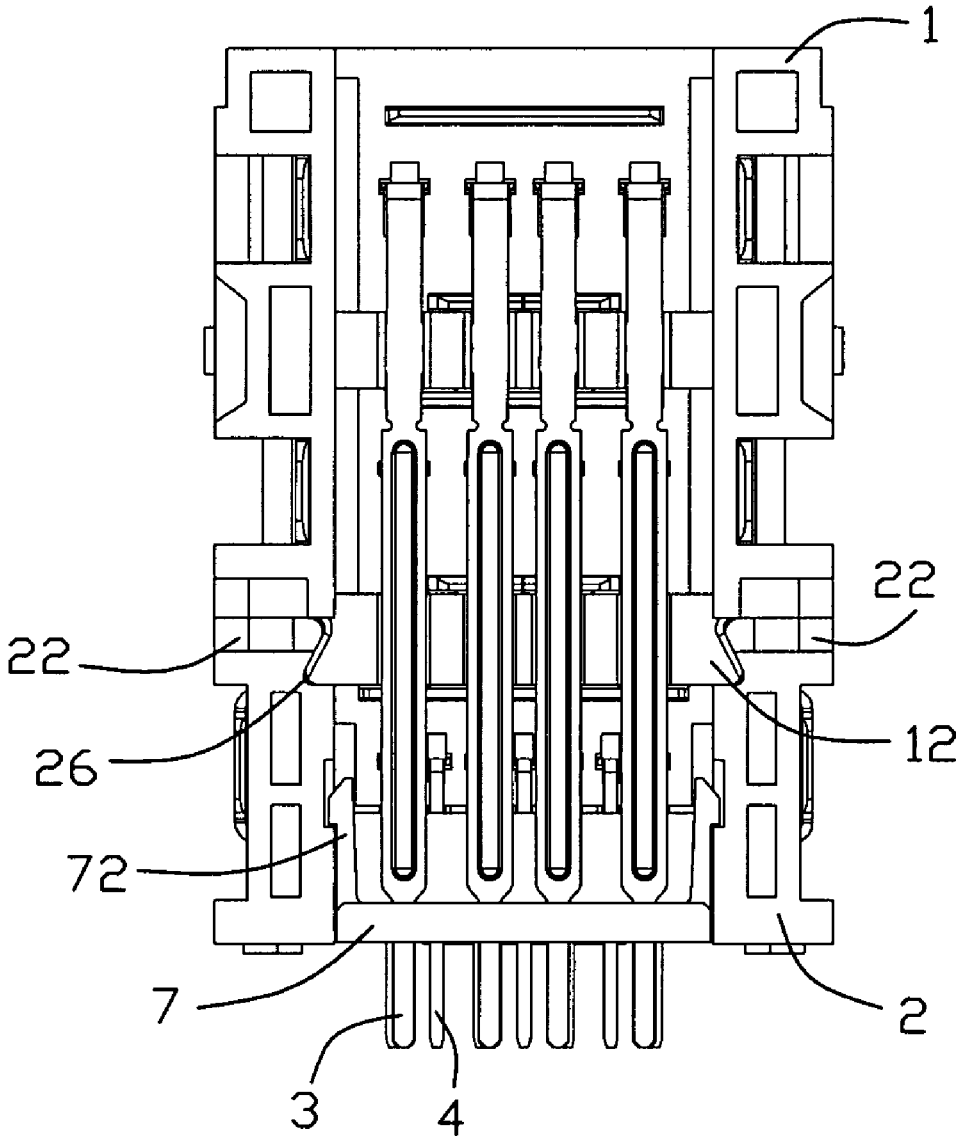
FIG. 7 is a rear elevational view of the electrical connector assembly without the outer shell and the rear shell shown in FIG. 1.

Referring to FIGS. 4-6, the first housing 1 defines a pair of first mating portions 11 both for mating with USB (Universal Serial Bus) plug connectors (not shown). The first housing 1 has a receiving space 15 in a rear end and a plurality of first retaining slots 17 communicating with the receiving space 15, a dove-tail protrusion 12 extending from a bottom surface thereof and a pair of first locking projections 13 formed on opposite sides thereof. The protrusion 12 has an upper portion and a lower portion wider than the upper portion. The protrusion 12 has a pair of stopping portions 14 forwardly at opposite sides thereof to limit a forward movement of the second housing 2 and a pair of grooves 125 in a bottom surface thereof. The second housing 2 defines a second mating portion 21 for mating with a SATA (Serial ATA) plug connector (not shown). The second housing 2 has a pair of second locking projections 23 at opposite sides thereof and a receiving chamber 24 in a rear end thereof. A pair of notches 25 are defined at opposite side walls of the receiving chamber 24. The second housing 2 has a plurality of second retaining slots 27 rearwardly and communicating with the receiving chamber 24. The second housing 2 has a pair of retaining posts 22 having a upper portion and a lower portion being narrower than the upper portion and extending from a top surface thereof. A dove-tail recess 26 is formed between the retaining posts 22 to retain the protrusion 12 therein and communicates with the receiving chamber 24. Thereby the recess 26 has an upper portion and a lower portion wider than the upper portion. The first housing 1 can be coupled to the second housing 2 reliably via the locking engagement between the protrusion 12 and the recess 26. The stopping portions 14 abutting against the front end of the retaining posts 22 to limit a forward movement of the second housing 2. The recess 26 communicates with the receiving space 15. The first housing 1 and the second housing 2 which have two different types of interfaces could be different in color so as to be identified easily and could be manufactured respectively so as to be molded easily.

Referring to FIGS. 4 and 5, each first terminal 3 includes a first contacting portion 31 for engaging with an appropriate terminal of the USB plug connector, a first tail portion 33 for electrical connection to an appropriate circuit trace on a printed circuit board (not shown), and a first jointing portion 32 connecting the first contacting portion 31 and the first tail portion 33. The first contacting portion 31 extends into the first mating portion 11. The first jointing portion 32 extends downwardly from the first contacting portion 31 to be retained in the appropriate first retaining slot 17 and go through the receiving space 15 of the first housing 1.

Each second terminal 4 includes a second contacting portion 41 for engaging with an appropriate terminal of the SATA plug connector, a second tail portion 43 for electrical connection to an appropriate circuit trace on the printed circuit board, and a second jointing portion 42 connecting the second contacting portion 41 and the second tail portion 43. The second jointing portion 42 extends downwardly from the second contacting portion 41 to be retained in the appropriate second slot 27 of the second housing 2.

The first inner shells 5 are received in the first mating portions 11. Each first inner shell 5 has a plurality of first fingers 51 formed at a top surface, a bottom surface and opposite sides thereof for engaging with an appropriate shell of the complementary USB plug connector. Each first inner shell 5 has a pair of first legs 52 projecting rearwardly thereof and coupled to opposite outsides of the first housing 1. The first legs 52 have a pair of first perforations 53 for engaging with the first locking projections 13.

The second inner shell 6 encloses the second mating portion 21 of the second housing 2. The protrusion 12 of the first housing 1 abuts against a top surface of the second inner shell 6 to prevent the second inner shell 6 from deformation. The second inner shell 6 has a pair of second fingers 61 formed at the top surface and received in the grooves 125 of the protrusion 12 and a pair of second fingers 61 formed at a bottom surface thereof. The second inner shell 6 has a pair of second legs 62 projecting rearwardly thereof and coupled to opposite outsides of the second housing 2. The second legs 62 have a pair of second perforations 63 for engaging with the second locking projections 23.

The spacer 7 is received in the receiving chamber 24 and has a plurality of holes 71 for retaining the first terminals 3 and the second terminals 4. The spacer 7 has a pair of bulking arms 72 for engaging with the notches 25.

The outer shell 8 has a plurality of contacting tabs 81 bent inwardly for electrically contacting the first legs 52 and the second legs 62 so as to eliminate the static electricity on the first shell 5 and the second shell 6. The outer shell 8 has a plurality of apertures 82 and latching barbs 83 at a rear end thereof. The latching barbs 83 are bent inwardly to latch the first housing 1 and the second housing 2. The rear shell 9 has a plurality of latching tabs 92 for engaging with the apertures 82.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly combining at least two different types of interfaces, comprising:

a first housing having a first mating portion at a front surface, a first inner shell is received in the first mating portion and a protrusion extending from a bottom surface thereof, the protrusion having an upper portion and a lower portion being wider than the upper portion;

a plurality of first terminals mounted on said first housing and extending into the first mating portion thereof;

a second housing assembled to the first housing, the second housing having a second mating portion at a front surface and a recess at a top surface thereof to retain the protrusion therein, the recess having an upper portion and a lower portion being wider than the upper portion;

a plurality of second terminals mounted on said second housing and extending into the second mating portion thereof; and a second inner shell enclosing the second mating portion of the second housing, the second inner shell having a top surface being abutted against by the protrusion;

wherein the second inner shell has a pair of second fingers at the top surface, the protrusion has a pair of grooves to receive the fingers; and the electrical connector assembly has a spacer coupled to the second housing, the spacer has a plurality of holes for retaining the first and the second terminals and the second housing has a receiving chamber to receive the spacer and communicating with the recess.

2. The electrical connector assembly as claimed in claim 1, wherein the protrusion has a pair of stopping portions being adjacent to the front surface to limit a forward movement of the second housing.

3. The electrical connector assembly as claimed in claim 1, wherein the first inner shell has a pair of first legs rearwardly extending from opposite sides thereof and coupled to opposite outsides of the first housing.

4. The electrical connector assembly as claimed in claim 3, wherein the second inner shell has a pair of second legs rearwardly extending from opposite sides thereof and coupled to opposite outsides of the second housing.

5. The electrical connector assembly as claimed in claim 4, wherein the electrical connector has an outer shell enclosing the first and second housing, the outer shell has a plurality of contacting tabs at opposite sides thereof to contact the corresponding first and second legs.

6. The electrical connector assembly as claimed in claim 5, wherein the outer shell has a plurality of latching barbs to latch the first and second housing.

7. The electrical connector assembly as claimed in claim 1, wherein the first housing has a plurality of first retaining slots for retaining the first terminals and a receiving space for the first terminals going through, the receiving space communicates with the recess of the second housing.

8. An electrical connector assembly, comprising:

a first housing having a pair of first mating portions for mating with USB plug connectors, a pair of first inner shells is received in the first mating portion, and a protrusion extending from a bottom surface thereof, the protrusion having an upper portion and a lower portion wider than the upper portion;

a plurality of first terminals mounted on said first housing and extending into the first mating portion thereof;

a second housing assembled to the first housing, the second housing having a second mating portion for mating with SATA plug connectors and a pair of retaining posts extending from a top surface thereof, the retaining posts engaged with opposite sides of the protrusion and having an upper portion and a lower portion narrower than the upper portion;

a plurality of second terminals mounted on said second housing and extending into the second mating portion thereof; and a second inner shell enclosing the second mating portion of the second housing, the second inner shell having a top surface abutted against by the protrusion;

wherein the second inner shell has a pair of fingers at the top surface, the protrusion has a pair of grooves to receive the fingers; and the electrical connector assembly has a spacer coupled to the second housing, the spacer has a plurality of holes for retaining the first and the second terminals and the second housing has a receiving chamber to receive the spacer and communicating with the recess.

9. The electrical connector assembly as claimed in claim 8, wherein the protrusion has a pair of stopping portions abutting against the retaining posts to limit a forward movement of the second housing.

10. The electrical connector assembly as claimed in claim 8, wherein the each of the pair of first inner shells has a pair of first legs rearwardly extending from opposite sides thereof and coupled to opposite outsides of the first housing.

11. The electrical connector assembly as claimed in claim 10, wherein the second inner shell has a pair of second legs rearwardly extending from opposite sides thereof and coupled to opposite outsides of the second housing.

12. The electrical connector assembly as claimed in claim 11, wherein the electrical connector has an outer shell enclosing the first and the second housing, the outer shell has a plurality of contacting tabs at opposite sides thereof to contact the corresponding first and second legs.

* * * * *